US005096098A

United States Patent [19]

Garcia

[11] Patent Number: 5,096,098

[45] Date of Patent: Mar. 17, 1992

[54] PUSHBUTTON FOR ACTUATING A DISPENSER FOR SEMI-LIQUID SUBSTANCES

[75] Inventor: Firmin Garcia, Evreux, France

[73] Assignee: Valois, Le Neubourg, France

[21] Appl. No.: 606,972

[22] Filed: Oct. 31, 1990

[30] Foreign Application Priority Data

Nov. 7, 1989 [FR] France ..... 89 14597

[51] Int. Cl.[5] ..... B65D 83/00

[52] U.S. Cl. ..... 222/402.13; 222/518; 239/354; 239/569

[58] Field of Search ..... 222/402.12, 402.13, 222/509, 559, 495, 496, 506, 518, 150, 149; 239/337, 353, 354, 569

[56] References Cited

U.S. PATENT DOCUMENTS

| | | | |
|---|---|---|---|
| 3,323,695 | 6/1967 | Monahon | 222/402.13 X |
| 3,584,789 | 4/1971 | Traynor | 222/149 X |
| 3,642,179 | 2/1972 | Micallef | 222/402.13 X |
| 3,887,115 | 6/1975 | Petterson | 222/402.13 |
| 3,991,916 | 11/1976 | Del Bon | 222/402.13 |
| 4,723,725 | 2/1988 | Comment | 222/496 X |
| 4,798,311 | 1/1989 | Workum | 222/496 X |
| 4,957,239 | 9/1990 | Tempelman | 222/149 X |
| 5,027,982 | 7/1991 | Demarest | 222/402.13 |
| 5,037,015 | 8/1991 | Collins | 222/509 X |

FOREIGN PATENT DOCUMENTS

| | | | |
|---|---|---|---|
| 1557485 | 3/1968 | France | 222/402.13 |

*Primary Examiner*—Kevin P. Shaver
*Assistant Examiner*—Anthoula Pomrening
*Attorney, Agent, or Firm*—Sughrue, Mion, Zinn, Macpeak & Seas

[57] ABSTRACT

A problem which arises with dispensers for semi-liquid substances lies in there being an outlet channel which is permanently in communication with ambient air. After first use of the dispenser, the corresponding dead volume is filled with semi-liquid substance which quickly becomes spoiled; thereby making subsequent utilization at least difficult and possibly toxic or even impossible. The present invention avoids this difficulty by means of a pushbutton in which the outlet channel is defined by co-operation between a flexible part and a rigid part. The outlet channel extends essentially radially and its volume is reduced when the user applies axial pressure on the pushbutton. A motion transforming system for transforming axial displacement into radial displacement serves simultaneously to retract a plunger received in the outlet channel, thereby disengaging the delivery orifice of the pushbutton. Such a pushbutton is particularly advantageous when used in association with a metering pump type dispenser valve which can then be made without its own outlet valve.

11 Claims, 2 Drawing Sheets

FIG. 1
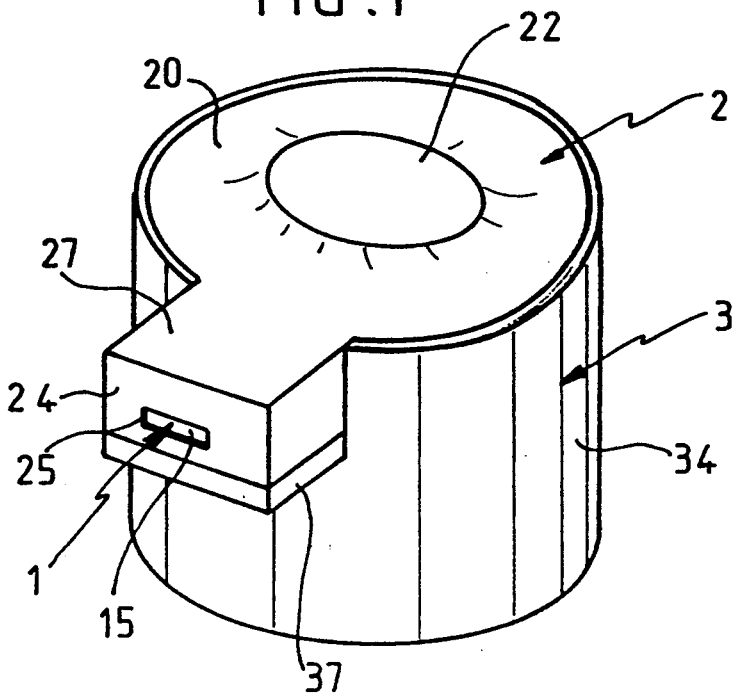
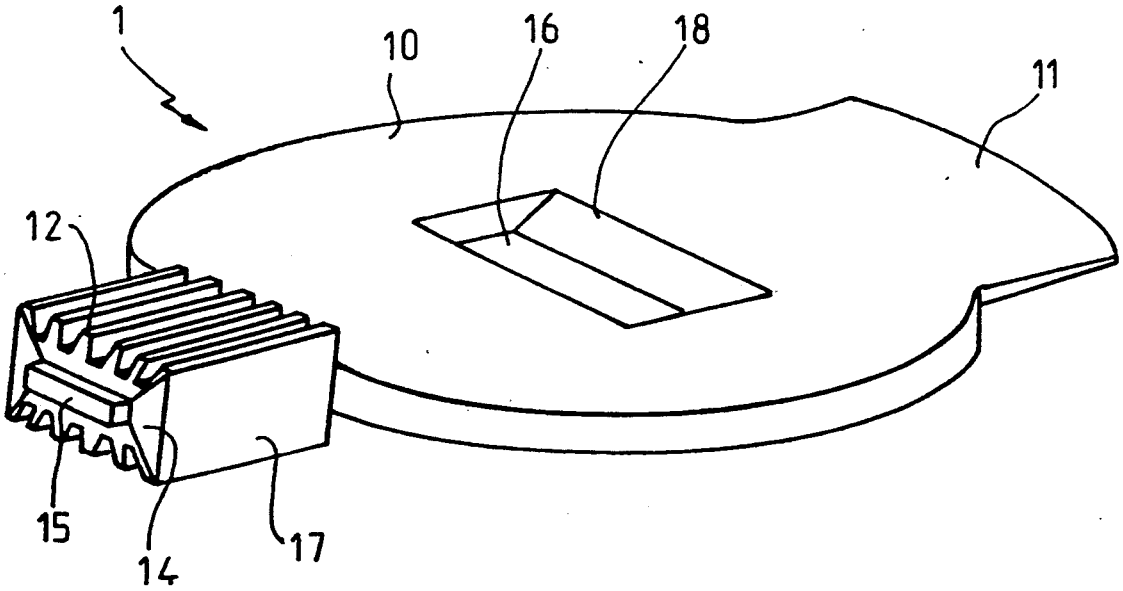
FIG. 4

FIG. 2
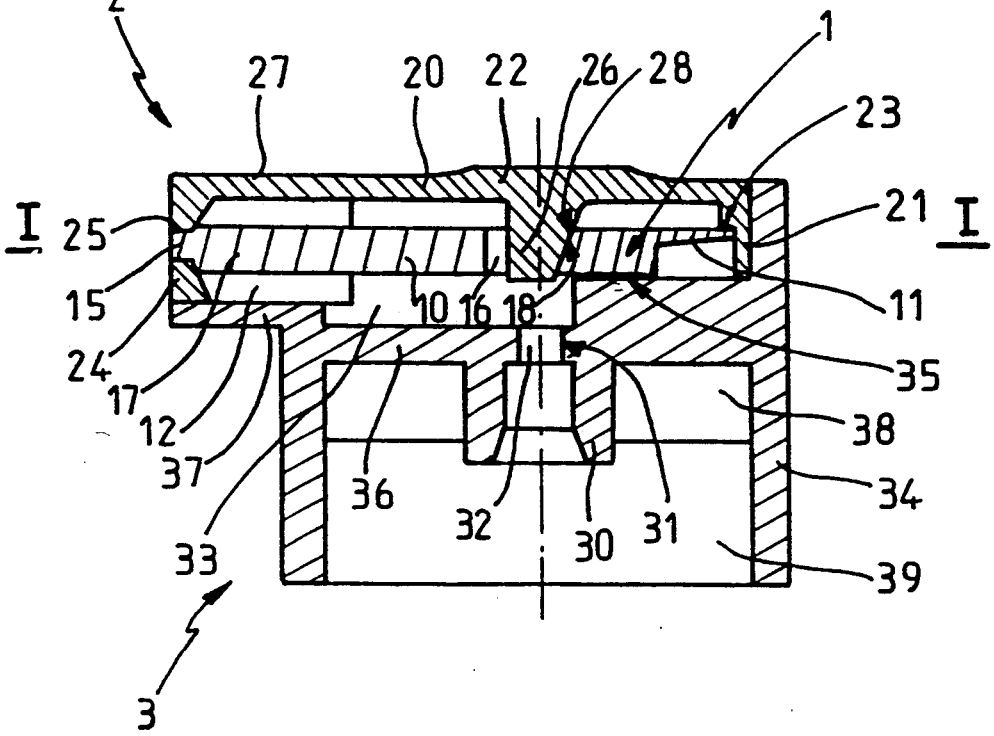
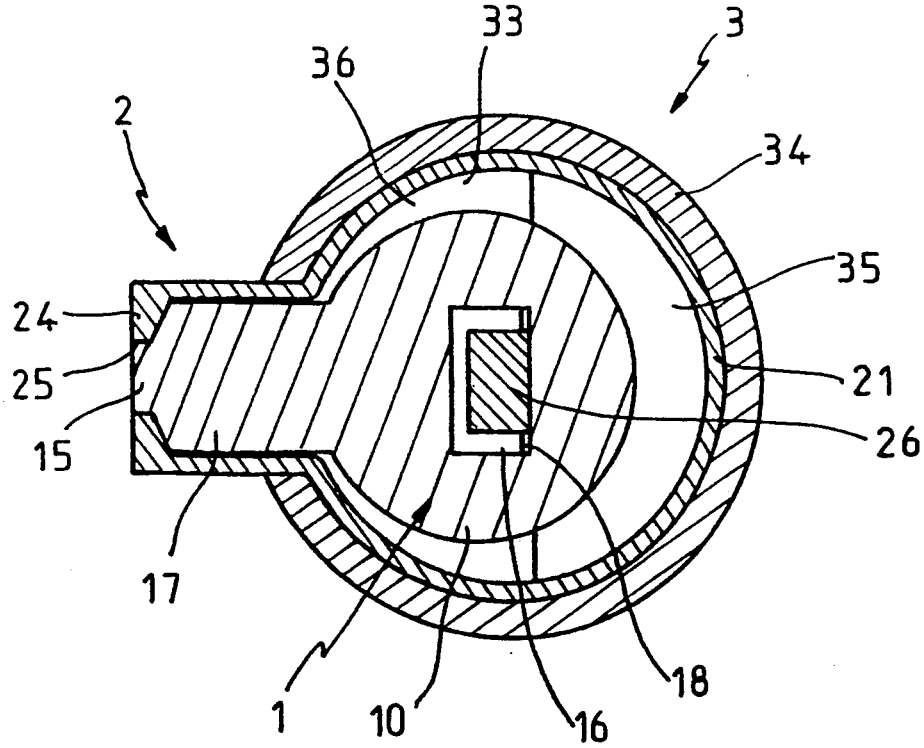
FIG. 3

PUSHBUTTON FOR ACTUATING A DISPENSER FOR SEMI-LIQUID SUBSTANCES

The present invention relates to a pushbutton for actuating a dispenser for semi-liquid substances.

BACKGROUND OF THE INVENTION

In the food, pharmaceutical, and cosmetics industries it is advantageous to be able to package relatively fluid substances in individual dispensers. Such dispensers comprise a dispenser valve mounted in a sealed manner on a container containing the substance. The valve conventionally comprises a hollow rod which is pushed down for the purpose of opening the valve and the substance is then delivered along the rod. In order to facilitate this operation, it is conventional to provide a pushbutton which is adapted firstly to engage on the hollow rod of the valve and secondly to provide a purchase for the user of the dispenser. The pushbutton then includes an outlet channel establishing communication between the rod and an orifice in the surface of the pushbutton through which the substance is delivered.

When used with semi-liquid substances such as creams, lotions, and other pastes, such dispensers nevertheless suffer from a problem relating to the outlet channel of the pushbutton. After the dispenser has been actuated for the first time, this channel fills up with the substance. As a result, a certain quantity of substance remains trapped in the channel. After actuation, the substance generally remains therein, in contact with ambient air via the outlet orifice. Depending on the nature of the substance, it may then be degraded, for example the substance may dry out and harden inside the outlet channel, thereby blocking it, or oxidation may denature the volume of substance contained in the channel, or it may become contaminated with bacteria from the surrounding water vapor, thereby rendering all further substance dispensed from the dispenser potentially harmful.

In the prior art, attempts have been made to solve this problem by providing the pushbutton with a valve for closing its outlet orifice. For this purpose, European patent application EP-A-O 129 643 filed in 1984 by Pfeiffer proposes using a needle fixed to two pistons placed inside the outlet channel of the pushbutton. The needle co-operates when at rest with the outlet orifice which then constitutes the seat of the valve. While dispensing is taking place, the pressure delivered by the substance acts via the two pistons to withdraw the needle and thus open the orifice.

This system suffers from the drawback that the part used for obstructing the outlet orifice is difficult to manufacture. The two pistons it includes must be provided with sealing rings ensuring sealed contact with the inside wall of the outlet channel. However the diameter of the outlet channel is generally very small (a few millimeters). The molding of such fine lips so fine is so expensive that the cost of the pushbutton is no longer compatible with its purpose.

An object of the present invention is thus to provide a cheaper valve for the outlet channel of a pushbutton for dispensing semi-liquid substances.

SUMMARY OF THE INVENTION

To this end, the present invention provides a pushbutton for actuating a dispenser for a semi-liquid substance, the dispenser including a dispenser valve having a hollow rod through which said substance flows when said rod is pushed into said valve, said pushbutton being provided with an outlet channel and a rod-receiving sleeve which is cylindrical about an axis of revolution, an end of said rod engaging an abutment in the sleeve and communicating with said outlet channel, said channel opening out to the outside via a radial delivery orifice, the pushbutton being further provided with a thrust surface perpendicular to the axis of said sleeve in order to receive thrust from a user of said dispenser, the pushbutton being constituted by:

a head fixed to said sleeve;

a cover whose base determines said thrust surface and which, together with said head delimits said outlet channel; and a closure part received in said outlet channel and bearing against said delivery orifice under the effect of resilient means, one of the components of the assembly comprising said head and said cover being constituted by a material which is more flexible than the other, and a motion transformation system being provided for transforming translation parallel to the axis of said sleeve into translation perpendicular to said axis, such that once said rod has been thrust into said valve, thrust from the user causes that one of said elements which is constituted of the more flexible material to deform, thereby reducing the volume of the outlet channel and, via said motion transformation system, causing said closure part to move against said resilient means, thereby opening said delivery orifice.

The present pushbutton thus makes use of three parts: a head, a cover, and a closure part, all three parts being easy to manufacture. Since none of these parts includes a complex hollow or recess, they can all be molded without difficulty. In addition they are assembled together merely by being fitted together. Further, the valve constituted in this way in the outlet orifice operates mechanically. The pushbutton therefore remains reliable regardless of the pressure conditions applicable to the substance leaving the dispenser valve.

Finally, the pushbutton is advantageously associated with a metering pump type dispensing valve that does not include its own outlet non-return valve. In such a context, the deformability of one of the component parts ensures that the volume of the outlet channel increases suddenly as soon as the user ceases to exert a compression force thereon. As a result the suction in the pump chamber is increased while the pump piston is rising, thereby improving admission of the substance.

In other words, the efficiency of such as association including the present pushbutton is enhanced.

BRIEF DESCRIPTION OF THE DRAWINGS

An embodiment of the invention is described by way of example with reference to the accompanying drawings, in which:

FIG. 1 is a perspective view of a pushbutton of the present invention;

FIG. 2 is an axial section through the FIG. 1 pushbutton;

FIG. 3 is a cross-section on a plane I—I of FIG. 2; and

FIG. 4 is a perspective view of the closure part for closing the delivery orifice of the pushbutton shown in the above figures. This perspective view is at a larger scale than the other figures.

DETAILED DESCRIPTION

A pushbutton of the present invention may have the appearance shown in the perspective view of FIG. 1. Seen from the outside, this figure shows that the pushbutton comprises two parts: an essentially cylindrical head 3 together with a cover 2 engaged on the top of the head 3. It is a feature of the present invention that these two parts are not made of the same material. For example the head 3 is made of a relatively rigid plastics material while the cover 2 is made of a plastics material that is much more flexible.

As seen in the axial section of FIG. 2, the head 3 of the pushbutton includes a cylindrical wall 34 that is open at the top and at the bottom. An internal partition 36 extends perpendicularly to the axis of the wall 34, splitting it into two compartments. The bottom compartment 39 is designed to enable the pushbutton to be fitted on a dispenser for a semiliquid substance. The dispenser (not shown) comprises a dispenser valve and a container containing the substance, with the container being closed in sealed manner by its valve. The top compartment 33 is reserved for the function of delivering the substance.

More precisely, a cylindrical sleeve 30 about the same axis as the wall 34 projects down from the partition 36 into the bottom compartment 39. The sleeve 30 is adapted to be a push-fit on the rod of the dispenser valve. The rod comes into abutment against a narrower section portion 31 of the sleeve 30 and communicates with a passage 32 passing through the partition 36 between the above-defined bottom and top compartments 39 and 33. Generally speaking, the wall 34 extends downwards beneath the sleeve 30, and radial partitions 38 may be molded inside the bottom compartment 39 between the sleeve 30 and the wall 34 for the purpose of stiffening the sleeve. In addition, the wall 34 is designed to fit on the dispenser valve while leaving clearance around the valve and relative to the container on which the valve is mounted. The bottom portion of the wall 34 can then participate in guiding the pushbutton during its axial displacement relative to the dispenser valve.

In the top compartment 33, the partition 36 has a step 35. As explained below, the step serves to hold a closure part 1 inside the outlet channel of the pushbutton. The step 35 corresponds, for example, to a portion of the partition 36 having increased thickness and occupying the entire area of a segment inside the wall 34 and delimited by a chord parallel to the diameter of the wall. The chord is disposed so that the passage 32 is situated outside the thicker portion of the partition 36. The wall 34 also includes a top notch. This notch preferably extends over an arc of the wall having a chord which is parallel to the chord delimiting the step 35. A spout 37 projects out from the wall 34 perpendicularly to the axis of the head 3 and from the bottom edge of the notch. The width of the spout 37 is limited to a fraction of the diameter of the wall 34. Its far edge is advantageously parallel to the above-mentioned chord of the notch.

The cover 2 is shaped to constitute the top of the head 3 by fitting within the top compartment 33. As can be seen in the sections of FIGS. 2 and 3, the cover 3 thus has an essentially circular base 20 with a cylindrical rim 21 around its periphery. The outside diameter of the rim 21 is suitable for enabling it to occupy the inside of the wall 34 with so little clearance as to ensure sealing contact. The rim 21 extends vertically over substantially the same distance as the vertical extent of the top compartment 33 of the head 3. In particular, it has a step or notch to enable the rim 21 to fit over the step 35 on the partition 36.

Like the notch in the wall 34, the base 20 of the cover 2 extends as a projection 27 having the same area as the spout 37. Simultaneously the rim 21 ceases to be cylindrical in shape and occupies the sides of the projection 27. As a result the sides are exposed to the outside, and together with the spout 37 they define the laterally-extending nozzle of the pushbutton. The end wall 24 of the projection 27 extending parallel to the chord of the notch in the wall 34 is pierced by a through rectangular opening which constitutes a delivery orifice 25. In order to guarantee sealing of the nozzle relative to the substance to be dispensed, the edges of the sides of the rim of the cover may, where necessary, be glued to the spout 37.

Although the rim 21 is mostly of constant thickness, two exceptions should be mentioned. Firstly, the end wall 24 including the delivery orifice 25 preferably has an inside surface which tapers towards the orifice 25. Secondly, an arc of the rim 21 diametrically opposite to the section 27 includes a shoulder 23 facing the partition 36. The purpose of the shoulder 23 is to hold the closure part 1, as described below.

Returning to the base 20 of the cover 2, it includes several special features that are specific to the present invention. Its outside surface has a thickening 22. This thickening may describe, for example, a circle centered on the axis of the head 3. The user presses against this circle in order to actuate the dispenser fitted with the present pushbutton. Level with the thickening 22, but on the inside surface of the base 20, there is a projecting peg 26. As can be seen in FIG. 3, the cross-section of the peg 26 in a plane perpendicular to the axis of the head 3 is rectangular. In addition one of its sides is parallel to the chord defining the step in the wall 34. In axial section (see FIG. 2) the corresponding side of the peg 26 has a face 28 which is chamfered. Facing the shoulder 23 of the rim 21, this face 28 slopes so that the thickness of the peg tapers towards its tip which projects towards the partition 36. Finally, the base 20 is relatively thin around the thickening 22 and its peg 26 so as to facilitate deformation of the base. Because the cover 2 is relatively flexible, a user can cause the thickening 22 to move down relative to the top edge of the head 3 merely by pressing down on the thickening along the axis of the head. Simultaneously, the peg 26 is displaced slightly towards the partition 36.

Between the cover 2 and the head 3 there is a part 1 for closing the delivery orifice 25. This part is shown in greater detail in FIG. 4, and it essentially comprises a disk-shaped body 10 intended to be received in the top compartment 33 of the head 3, parallel to the partition 36 while resting on the step 35. Near the center of the body 10 there is an opening 16. The edges of the opening 16 form a rectangle in a plane parallel to that of the disk, but only three of its sides are perpendicular to said plane. The fourth side 18 is a sloping side. Its angle of slope should be identical to that of the face 28 of the peg 26. The dimensions of the closure part 1 are such that the opening 16 through its body 10 receives the peg 26 of the cover 2. The face 28 then comes into contact with the sloping side 18 and remains in contact regardless of the amount of deformation imparted to the cover 2.

To ensure that the angles remain the same, the body 10 of the closure part 1 includes a tongue 11 which extends the top level of the surface of the body 10 facing the cover. The free end of the tongue 11 is thus clamped beneath the shoulder 23 of the rim 21 of the cover 2. Because of its tapering section, the tongue 11 is suitable for warping and thus for allowing the body 10 to move in translation over the step 35. In order to ensure that this translation takes place perpendicularly to the axis of the head 3, the tongue 11 extends substantially in said perpendicular direction. The explanation given below on the method of operation of the present pushbutton will demonstrate why such translation motion is advantageous.

Diametrically opposite to the tongue 11, a plunger 17 projects from the body 10. Its overall shape is generally in the form of a rectangular parallelipiped which is complementary in shape to the nozzle constituted by the projection 27 on the cover 2 and the spout 37 on the head 3. However, grooves 12 are formed in two of the parallel faces of the body 10. In addition, its front face 14 is not plane. It is in the form of four sloping facets which match the inside shape of the end wall 24 of the projection 27. In the center of the front face 14 there is a portion 15 in relief which is adapted to slide through the delivery orifice 25. The portion in relief 15 and the facets of the front face 14 are shaped to facilitate automatic centering of the punch inside the nozzle.

So long as the present pushbutton is at rest, i.e. so long as the cover 2 is not deformed, the cover 2, the closure part 1, and the head 3 occupy the relative positions shown in FIGS. 2 and 3. The tongue 11 on the closure part 1 is then substantially straight. Nevertheless, a small amount of stress ensures that the front face 14 of the plunger 17 is urged against the end face 24 of the projection 27. As a result the facets of the front face bear against the flexible material of the cover 2 in the immediate vicinity of the delivery orifice 15. This ensures that the orifice 15 is closed in a sealed manner.

In contrast, when a user presses the pushbutton, the user presses against the thickening 22 on the outside surface of the base 20 of the cover 2. Thus, once the pushbutton has been pressed down on the dispenser valve far enough to push back the hollow rod completely, the base 20 begins to deform. This causes the peg 26 to move axially towards the partition 36, and as a result the sloping face 28 of the peg 26 slides over the sloping side 18 of the body 10 of the closure part 1. Consequently, the closure part is urged to move in its own plane against the rim 21 including the shoulder 23 clamped against the tongue 11, thereby warping the tongue 11. Simultaneously, the plunger 17 moves in translation relative to the nozzle. The portion in relief 15 comes out from the delivery orifice 25. From this moment, the substance flowing via the hollow rod of the open valve can be delivered by passing through the passage 32 in the partition 36, into the top compartment 33 of the head 3, and finally along the grooves 12 in the plunger 17 so that together these various paths constitute the outlet channel of the pushbutton.

When no more substance is to be delivered, the user releases the force on the pushbutton and the cover 2 returns to its initial shape. Overall, the volume of the outlet channel which had been reduced while the pushbutton was compressed now increases suddenly. Simultaneously, as the peg 26 rises, the body 10 of the closure part 1 is free to return to its initial position under thrust from the tongue 11 returning to its initial shape. When the plunger 17 comes back into abutment against the end face 24 of the projection 27 the delivery orifice 15 is reclosed. All of the substance still contained in the outlet channel constituted by the passage 32, the top compartment 33, and the grooves 12 is thus isolated from ambient air and therefore runs no risk of being spoiled by coming into contact with it.

The person skilled in the art will observe that a similar mechanism for closing the delivery orifice could be obtained using the following variants of the pushbutton:

a) The cover 2 could be more rigid than the head 3, in which case the step 35 can be merely a projection so that the thickness of the partition 36 can be reduced around the ring surrounding the sleeve 30. In this variant, once the hollow rod of the valve has been fully pushed home, user pressure causes the partition 36 to deform. This moves the projection and the closure part 1 towards the cover 2. Engagement of the peg 26 further into the opening 16 through the part 1 thus causes the plunger 17 to be retracted as described above.

b) The peg 26 is fixed to the head 3 while a projection is provided on the inside surface of the base 20 of the cover 2. Naturally, in this case, the positions of the peg 26 and of the step 35 should be interchanged. The more flexible element could be either the cover 2 or the head 3, so this configuration in fact gives rise to a total of two further variants of the pushbutton.

c) The system comprising the peg 26 of the opening 16 may be replaced by any other system suitable for transforming translation motion in one direction in three dimensions into translation motion in another direction perpendicular to the first. This may be done, for example, by means of a tooth cooperating with a notch.

d) The tongue 11 may be replaced by any resilient means opposing displacement in translation of the closure part. From this point of view, a spring could be used even though there may be a problem with the spring gradually spoiling in contact with the substance to be delivered.

e) The exact shapes of the wall 34 and the head 3, of the nozzle determined by the projection 27 on the cover 2 and by the spout 37, and of the closure part 1 itself may all be altered, the only feature that must be retained is that the substance should be dispensed laterally. In other words, the substance should always be delivered radially relative to the axis of a sleeve 30 receiving the hollow rod of the dispenser valve.

The present pushbutton thus includes a delivery orifice valve which is opened mechanically. The plunger 17 is withdrawn into the nozzle so long as the user maintains pressure on the base 20 of the cover. As a result, this valve may advantageously be used as an outlet valve of a pump. In this case, the dispenser valve may be constituted, for example, merely by a pump body receiving a piston which is biased by a return spring and which includes an admission valve. The association of such a dispenser valve with a pushbutton of the present invention including an outlet valve then provides a pump which is advantageous for several reasons.

Firstly, in operation, the deformability of the cover 3 or of the head 2 which together define the outlet channel provides an additional advantage since when the user releases pressure on the pushbutton, the deformable part returns to its initial shape. This causes the volume of the outlet channel to increase suddenly. However, since the closure part 1 housed in the outlet channel is simultaneously returned to its closed position, the delivery orifice is closed, thus giving rise to a suction effect which participates in causing substance to be admitted into the pump chamber.

From a manufacturing point of view, a pump obtained by associating a pump without an outlet valve and a pushbutton as described above and including an outlet valve is advantageous. The relative complexity of the pushbutton is counterbalanced by the simplified pump mechanism. It is commonly the case that systems for providing an outlet valve for such a pump mechanism often require parts to be made that are difficult to mold (e.g. a hollow rod including a small lateral channel).

Other applications of the present pushbutton will certainly occur to the person skilled in the art outside the particular field of dispensers for semi-liquid substances.

I claim:

1. A pushbutton for actuating a dispenser for a semi-liquid substance, the dispenser including a dispenser valve having a hollow rod through which said substance flows when said rod is pushed into said valve, said pushbutton being provided with an outlet channel and a rod-receiving sleeve (30) which is cylindrical about an axis of revolution, said sleeve having an abutment (31) for engaging the rod and for providing communication with said outlet channel, said channel opening out to the outside via a radial delivery orifice, the pushbutton being further provided with a thrust surface (22) perpendicular to the axis of said sleeve in order to receive thrust from a user of said dispenser, the pushbutton comprising:

a head (3) fixed to said sleeve;

a cover (2) whose base determines said thrust surface and which, together with said head delimits said outlet channel;

a closure part (1) received in said outlet channel and bearing against said delivery orifice under the effect of resilient means (11), one of said head and said cover being constituted by a material which is more flexible than the other, and a motion transformation system for transforming translation parallel to the axis of said sleeve into translation perpendicular to said axis, such that once said rod has been thrust into said valve, thrust from the user causes said one of the head and the cover which is constituted of the more flexible material to deform, thereby reducing the volume of the outlet channel and, via said motion transformation system, causing said closure part to move against said resilient means, thereby opening said delivery orifice.

2. A pushbutton according to claim 1, wherein said head comprises a wall (34) having a top end and a bottom end, said ends being open, said wall supporting, between said ends, a partition (36) extending perpendicularly to the axis of said sleeve, thereby defining a top compartment (33) and a bottom compartment (39), said sleeve extending from said partition into said bottom compartment and communicating with said top compartment via a passage (32) passing through said partition, said passage thus constituting a portion of said outlet channel.

3. A pushbutton according to claim 2, wherein said cover is adapted to close said top compartment of said head by sealed engagement at said top end of said wall, the empty space between said partition and said cover then constituting a portion of said outlet channel.

4. A pushbutton according to claim 3, wherein said sealed engagement is obtained by means of a peripheral rim (21) on said base of said cover and adapted to fit inside said wall.

5. A pushbutton according to claim 4, wherein said top end of said wall constituting said head includes a notch having one edge in a plane parallel to that of said partition, said edge being extended outside said wall by a spout (37), said base of said cover including a projection (27) adapted to overlie said spout, said rim of said cover defining sides of said projection, thereby enabling said cover and said spout to constitute a sealed nozzle which communicates with the outside via said radial delivery orifice (25) formed in an end wall (24) of said projection, said nozzle also constituting a portion of said outlet channel.

6. A pushbutton according to claim 5, wherein said sides of said projection of said cover are glued to said spout in order to seal the nozzle.

7. A pushbutton according to claim 5, wherein said closure part comprises a flat body adapted to fit inside said top compartment between said cover and said partition in a plane perpendicular to the axis of said sleeve, one of said base (20) of said cover and said partition of said head including a step (35) against which said body bears.

8. A pushbutton according to claim 7, wherein a plunger (17) projects radially from said body of said closure part so as to be capable of sliding inside said nozzle, one of the faces of said plunger being adapted to bear in sealed manner against the end wall of said projection including said delivery orifice, said one of the faces having a portion in relief projecting therefrom, said portion being complementary in shape to said delivery orifice, and at least one of the other faces of said plunger having grooves (12) formed therein.

9. A pushbutton according to claim 8, wherein said resilient means are constituted by a tongue (11) projecting radially from said body of said closure part, said tongue extending parallel to said body and being disposed diametrically opposite said plunger, said rim of said cover including a shoulder (23) against which a free end of said tongue is clamped.

10. A pushbutton according to claim 7, wherein said motion transformation system for transforming translation parallel to the axis of said sleeve into translation perpendicular to said axis is constituted by a peg (26) extending parallel to said axis of said sleeve inside said top compartment, together with an opening (16) formed through said flat body of said closure part and adapted to receive said peg with clearance, a face of said peg facing away from said nozzle having a slope (28) and remaining in contact with a side (18) of said opening having the same slope, the other one of said base of said cover and said partition of said head including said peg and being thinner around said peg.

11. A pushbutton according to claim 10, wherein said other one of said elements is said base of said cover, said thrust surface including a thickening provided on the outside of said base of said cover.

* * * * *